US010640934B2

(12) United States Patent
Magee et al.

(10) Patent No.: US 10,640,934 B2
(45) Date of Patent: May 5, 2020

(54) RECLAIMING DRUM HAVING INTERCHANGEABLE RECTANGULAR AND V-SHAPED PADDLES

(71) Applicant: CATERPILLAR PAVING PRODUCTS INC., Brooklyn Park, MN (US)

(72) Inventors: Kevin James Magee, Buffalo, MN (US); Mario Persano, Poggio Renatico (IT); Dario Sansone, Castello d'Argile (IT)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/810,402

(22) Filed: Nov. 13, 2017

(65) Prior Publication Data

US 2019/0143562 A1 May 16, 2019

(51) Int. Cl.

| | |
|---|---|
| ***E01C 23/08*** | (2006.01) |
| ***E01C 23/12*** | (2006.01) |
| ***B28D 1/18*** | (2006.01) |
| ***E01C 23/088*** | (2006.01) |

(52) U.S. Cl.
CPC ..... *E01C 23/127* (2013.01); *B28D 1/186* (2013.01); *E01C 23/088* (2013.01)

(58) Field of Classification Search
CPC ..... E01C 23/088; E01C 23/127
See application file for complete search history.

(56) References Cited

U.S. PATENT DOCUMENTS

| | | | | |
|---|---|---|---|---|
| 7,293,729 | B2 | 11/2007 | Ragnarsson | |
| 8,870,297 | B2 * | 10/2014 | Pederson | B23P 6/00 299/104 |
| 9,284,698 | B2 | 3/2016 | Buhr et al. | |
| 9,353,491 | B2 * | 5/2016 | Wachsmann | E01C 23/088 |
| 9,359,728 | B2 | 6/2016 | Wachsmann | |
| 2014/0361601 | A1 * | 12/2014 | Bush | E21B 10/56 299/105 |

FOREIGN PATENT DOCUMENTS

| | | |
|---|---|---|
| AU | 2010227706 | 9/2010 |
| WO | WO 2010/108743 | 9/2010 |

* cited by examiner

*Primary Examiner* — Janine M Kreck
(74) *Attorney, Agent, or Firm* — Finnegan, Henderso, Farabow, Garrett & Dunner, LLP

(57) ABSTRACT

A paddle for a reclaiming drum may include a block of material configured for attachment to a leading edge of a flighting supporting a cutting bit on the reclaiming drum, and the block of material may assist in breaking up and mixing material removed from a surface by the cutting bit as the reclaiming drum is rotated and moved into the surface. The paddle may include two ear portions protruding from opposite sides of a flat, centrally-located, aft-facing surface of the block of material, each of the ear portions including an inwardly-facing chamfered surface configured to interface with an outwardly-facing, leading edge chamfered surface of the flighting such that a gap is maintained between a flat leading edge surface of the flighting located in between the outwardly-facing chamfered surfaces and the flat, centrally-located, aft-facing surface of the block of material when the block of material is attached to the flighting.

20 Claims, 9 Drawing Sheets

RECLAIMING DRUM HAVING INTERCHANGEABLE RECTANGULAR AND V-SHAPED PADDLES

TECHNICAL FIELD

The present disclosure relates generally to a reclaiming drum and, more particularly, to a reclaiming drum having interchangeable rectangular and V-shaped paddles.

BACKGROUND

Roadways are built to facilitate vehicular travel. However, depending upon usage density, base conditions, temperature variation, moisture variation, and/or physical age, the surface of the roadways can eventually become misshapen, non-planar, unable to support wheel loads, or otherwise unsuitable for vehicular traffic. In order to promote continued use of the roadways, machines known as "road reclaimers" are employed to rehabilitate the roadways. A road reclaimer pulverizes the surface of the roadway and mixes the pulverized material with the underlying base to stabilize and reshape the roadway. The road reclaimer can also add asphalt emulsions or other binding agents during pulverization to enhance particular properties of the roadway.

A road reclaimer typically includes a frame quadrilaterally supported by tracked or wheeled drive units. The frame provides mounting for an engine, an operator's station, and a reclaiming drum. The reclaiming drum, fitted with cutting tools, is rotated through a suitable interface by the engine to pulverize the roadway.

In a typical configuration, multiple cutting tools extend from an external surface of the reclaiming drum in a spaced apart non-repeating checkerboard configuration. Each cutting tool includes a dedicated flighting that is welded to the reclaiming drum, a mounting block that is connected to the flighting, and a cutting bit that is held within the mounting block. During operation, the reclaiming drum is rotated to drive the cutting bits into the roadway surface and fragment the surface, and the flightings are pushed through the fragmented material to break the fragmented material into smaller particles. An exemplary road reclaimer is disclosed in U.S. Pat. No. 5,893,677 of Haehn et al. that issued on Apr. 13, 1999.

Although effective, operation of a conventional road reclaimer wears down the mounting blocks and flightings of the reclaiming drum. Historically, the mounting blocks and flightings have been protected from excessive wear by way of paddles located at leading edges of the cutting tools. The paddles are welded to individual flightings to deflect material away from the flightings and mounting blocks. In this configuration, the paddles themselves function to pulverize the fragmented material, while also acting as sacrificial wear components.

Although conventional paddles may be effective, they may also be costly, difficult, and time-consuming to replace. Specifically, after a period of use, each paddle must be cut off of the flighting and a new paddle must be welded in its place. This service is generally performed in a service facility and often results in extensive downtime of the road reclaimer. As material impacts the paddles during operation, failures may occur as the joints between each paddle and the flighting to which it is connected loosen and allow relative movement between the paddle and the flighting. Any loosening of the connection between a paddle and a flighting may result in failure as a result of the removal of the preload that was originally placed on fasteners joining the paddle to the flighting. This loosening of the connections may be aggravated by side impacts on the paddle during a reclaiming operation, which impart shearing loads on the fasteners joining the paddle to the flighting.

The paddles and reclaiming drum of the present disclosure solve one or more of the problems set forth above and/or other problems in the art.

SUMMARY

In one aspect, the present disclosure is directed to a paddle for a reclaiming drum. The paddle may include a block of material configured for attachment to a leading edge of a flighting supporting a cutting bit on the reclaiming drum, and the block of material may assist in breaking up and mixing material removed from a surface by the cutting bit as the reclaiming drum is rotated and moved into the surface. The paddle may also include two ear portions protruding from opposite sides of a flat, centrally-located, aft-facing surface of the block of material, each of the ear portions including an inwardly-facing chamfered surface configured to interface with an outwardly-facing, leading edge chamfered surface of the flighting such that a gap is maintained between a flat leading edge surface of the flighting located in between the outwardly-facing chamfered surfaces and the flat, centrally-located, aft-facing surface of the block of material when the block of material is attached to the flighting.

In another aspect, the present disclosure is directed to a cutting tool for a reclaiming drum. The cutting tool may include a plate-like flighting configured to be connected to the reclaiming drum at a first end in general alignment with a rotational direction of the reclaiming drum and supporting a cutting bit at a second end of the flighting, and a paddle. The paddle may include a block of material configured for attachment to a leading edge of the flighting, the block of material assisting in breaking up and mixing of material removed from a surface by the cutting bit as the reclaiming drum is rotated and moved into the surface. The paddle may also include two ear portions protruding from opposite sides of a flat, centrally-located, aft-facing surface of the block of material, each of the ear portions including an inwardly-facing chamfered surface configured to interface with an outwardly-facing, leading edge chamfered surface of the flighting such that a gap is maintained between a flat leading edge surface of the flighting located in between the outwardly-facing chamfered surfaces and the flat, centrally-located, aft-facing surface of the block of material when the block of material is attached to the flighting.

In yet another aspect, the present disclosure is directed to a reclaiming drum. The reclaiming drum may include a head having a cylindrical outer peripheral surface, a plurality of flightings separately joined at a first end to the reclaiming drum at spaced apart locations around the outer peripheral surface of the head, a tool mounting block fixedly connected to a second end of each of the plurality of flightings, a cutting bit disposed within each tool mounting block, a paddle removably connected at a leading edge of each of the plurality of flightings, and at least one fastener passing through the paddle and a radially extending portion of one of the plurality of flightings. Each paddle may include a block of material configured for attachment to the leading edge of the flighting, and two ear portions protruding from opposite sides of a flat, centrally-located, aft-facing surface of the block of material. Each of the ear portions may include an inwardly-facing chamfered surface configured to contact an outwardly-facing, leading edge chamfered surface of the flighting such that a gap is maintained between a flat leading edge surface of the flighting located in between the outwardly-facing chamfered surfaces and the flat, centrally-located, aft-facing surface of the block of material when the block of material is attached to the flighting.

DETAILED DESCRIPTION

Figure 1:
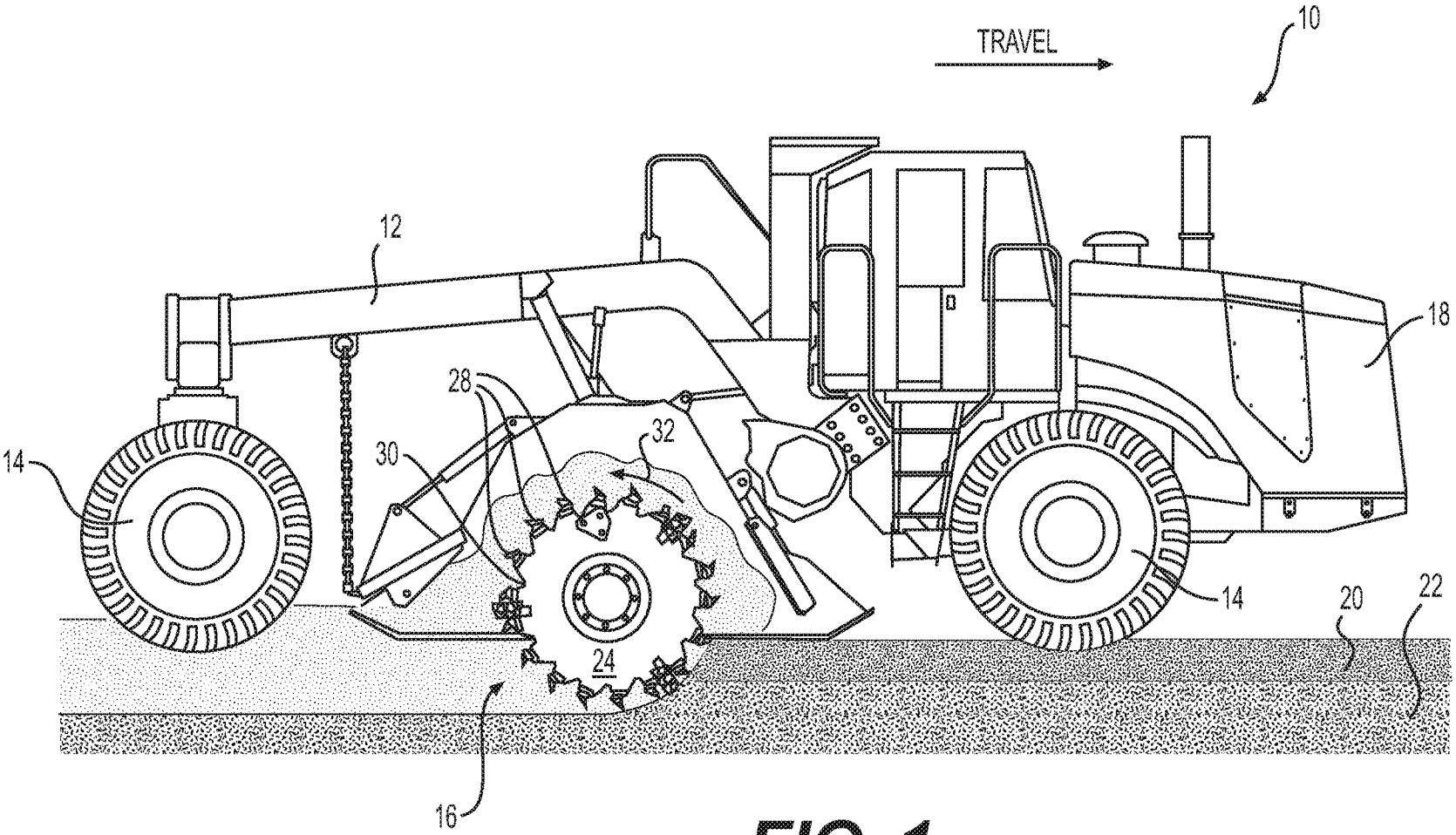
FIG. 1 is an illustration of an exemplary disclosed road reclaimer.

FIG. 1 illustrates an exemplary road reclaimer 10. Road reclaimer 10 may include a frame 12 connected to one or more traction units 14, and a reclaiming drum 16 supported from frame 12 at a general center of road reclaimer 10 between traction units 14. Traction units 14 may each include either a wheel or a track section that is pivotally connected to frame 12. An engine 18 (or other power source) may be configured to electrically, mechanically, hydraulically, and/or pneumatically power traction units 14 and reclaiming drum 16.

Reclaiming drum 16 may include components rotationally driven by engine 18 to pulverize asphalt and/or other material of a roadway surface 20 and to mix the pulverized material with a base 22 located below roadway surface 20. In some embodiments, an additive such as a soil stabilizer may also be mixed in with the asphalt and base to provide enhanced characteristics, if desired. Reclaiming drum 16 may include a rotary head 24 having a plurality of cutting tools 28 spaced apart along a cylindrical outer surface 30 in a general non-repeating checkerboard pattern. Cutting tools 28 may be pointed in a direction of rotation (indicated by an arrow 32), such that a tip end of each cutting tool 28 is driven into roadway surface 20 by the rotation of reclaiming drum 16 as reclaiming drum 16 is lowered into roadway surface 20.

Figure 2:
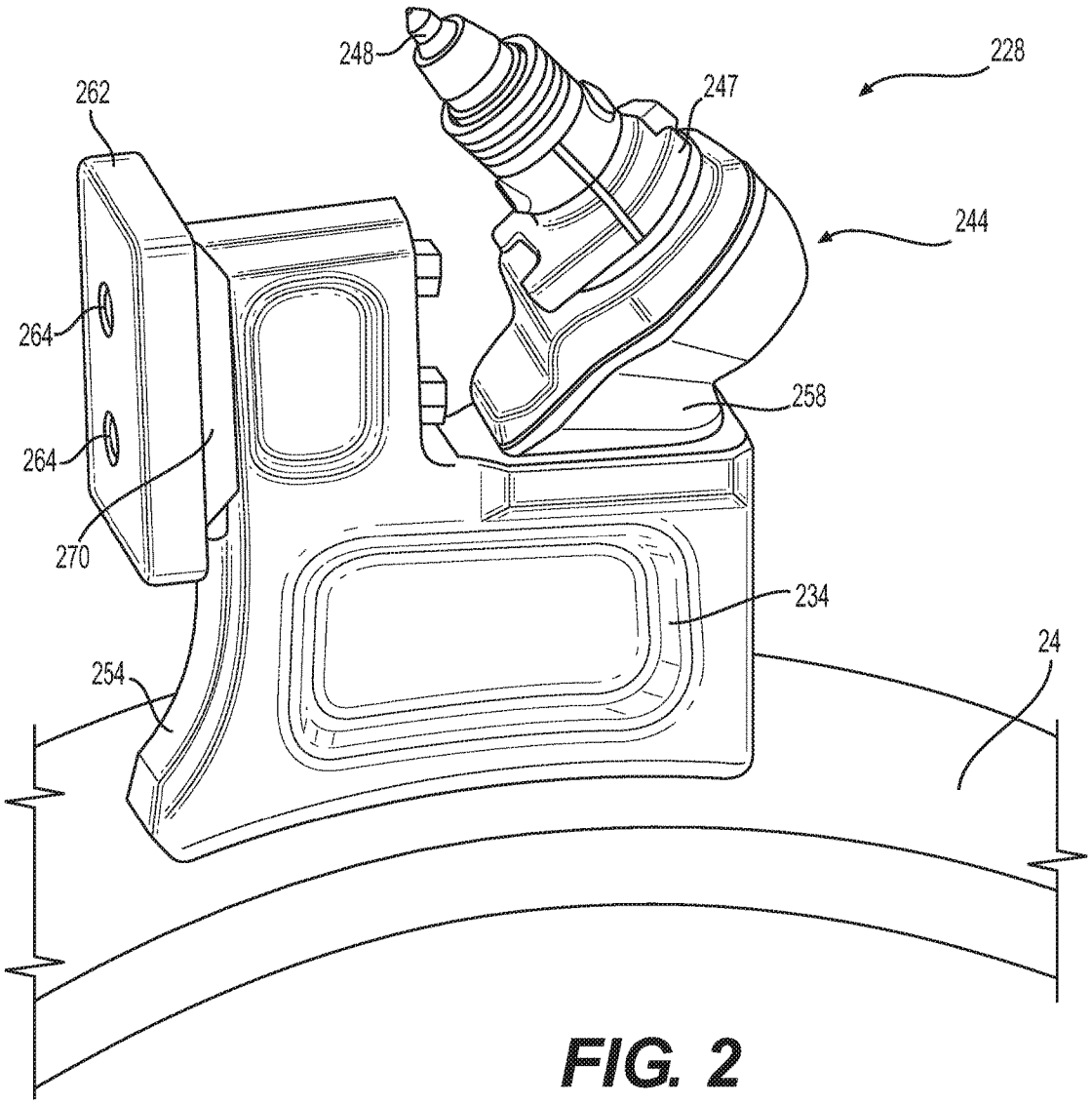
FIG. 2 is an illustration of an exemplary disclosed cutting tool with a rectangular-shaped paddle that may be used in conjunction with the road reclaimer of FIG. 1.

As shown in the exemplary embodiment of FIG. 2, a reclaiming drum according to this disclosure may include a plurality of cutting tools 228 spaced apart along a cylindrical outer peripheral surface of a rotary head 24. A plurality of flightings 234 may be separately joined at a first end to rotary head 24 at spaced apart locations around the cylindrical outer peripheral surface of rotary head 24. A base portion 258 of a tool mounting block 244 may be fixedly connected to a second end of each of the plurality of flightings 234. A cutting bit 248 may be disposed within each tool mounting block 244, with a base 247 of cutting bit 248 removably attached to tool mounting block 244.

Figure 3:
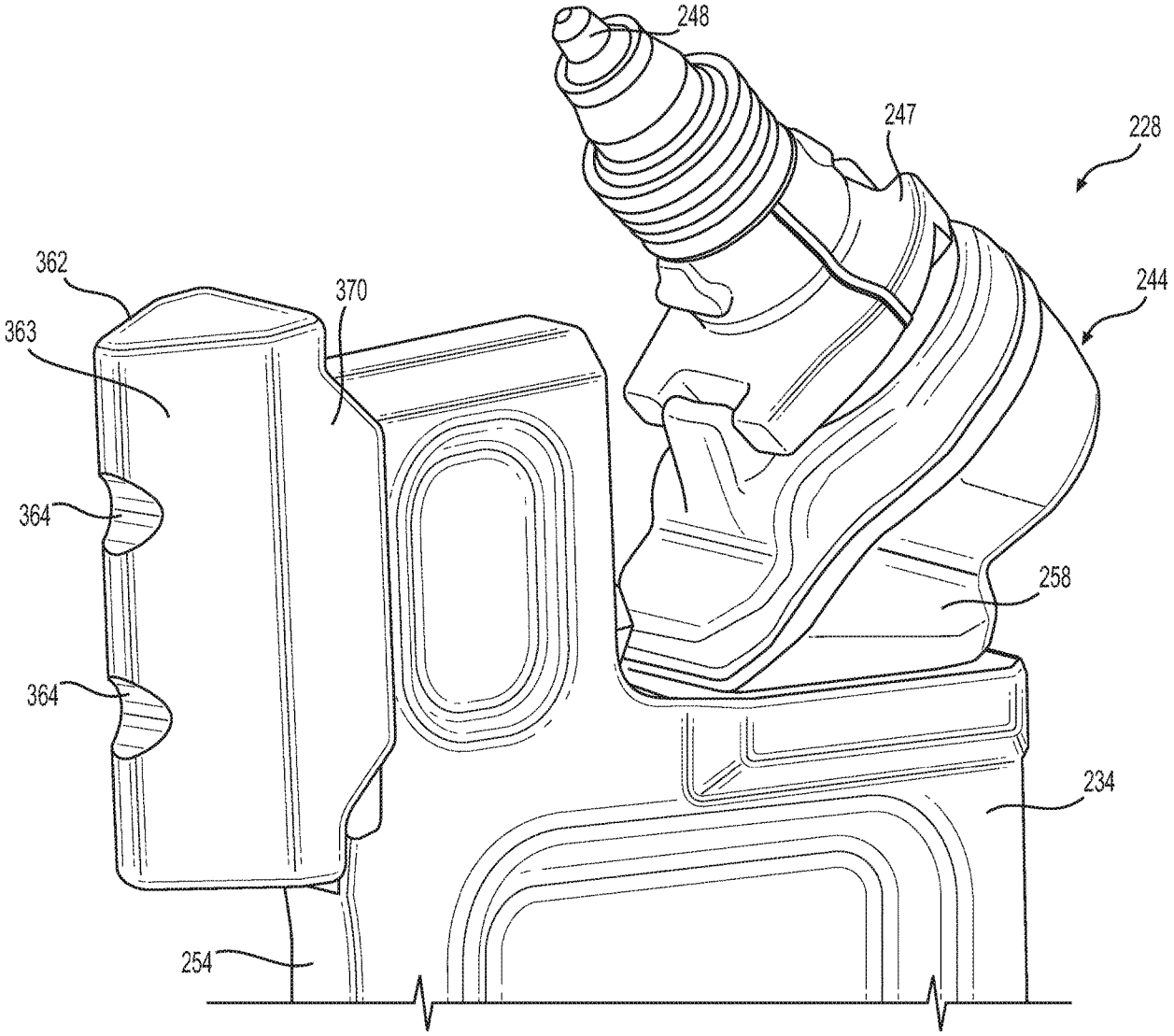
FIG. 3 is an illustration of an exemplary disclosed cutting tool with a V-shaped paddle that may be used in conjunction with the road reclaimer of FIG. 1.

A rectangular-shaped paddle 262 may be removably connected at a leading edge surface 254 of each of the plurality of flightings 234. In an alternative embodiment illustrated in FIGS. 3 and 6, cutting tool 228 may be associated with V-shaped paddles 362, which may be interchangeable with rectangular-shaped paddles 262. Paddles 262, 362 serve to break up and mix material after it has been cut from roadway surface 20 and base 22 by cutting bit 248. Rectangular-shaped paddles 262 may include a flat leading edge surface, while V-shaped paddles 362 may include a narrower, pointed leading edge surface with tapered side surfaces 363. Rectangular-shaped paddles 262 with flat leading edge surfaces may produce a material during a reclaiming operation that has a finer gradation than the material produced by a reclaiming drum with V-shaped paddles 362 having pointed leading edge surfaces. Material that has been cut from roadway surface 20 and base 22 is hit by paddles 262, 362 as rotary head 24 rotates, with the flat leading edge surfaces of rectangular-shaped paddles 262 causing more of an impact on the material than the pointed leading edge surfaces of V-shaped paddles. As a result, rectangular-shaped paddles 262 may break up the material that has been cut from roadway surface 20 and base 22 to a finer gradation than V-shaped paddles 362. V-shaped paddles 362 create less resistance as they break up and mix the material removed by cutting bits 248, thereby allowing a reclaiming drum equipped with the V-shaped paddles to rotate with less power than a reclaiming drum equipped with the rectangular-shaped paddles. In some alternative embodiments the reclaiming drum may include both rectangular-shaped paddles and V-shaped paddles, and rectangular-shaped paddles 262 and V-shaped paddles 363 may be interchangeable at will depending on particular applications for reclaiming drum 16.

Figure 4:
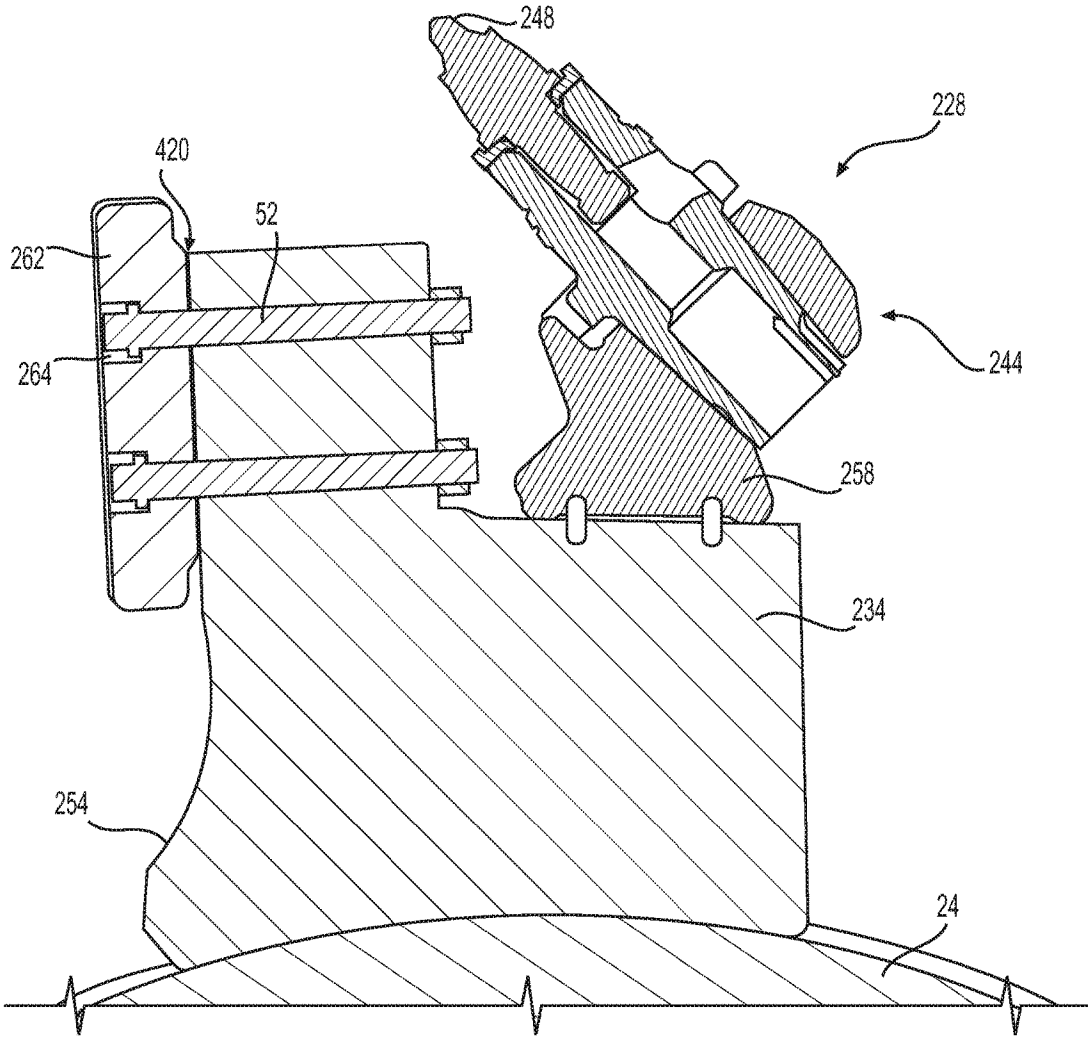
FIG. 4 is a cross-sectional elevation view of the cutting tool with the rectangular-shaped paddle of FIG. 2.
Figure 5:
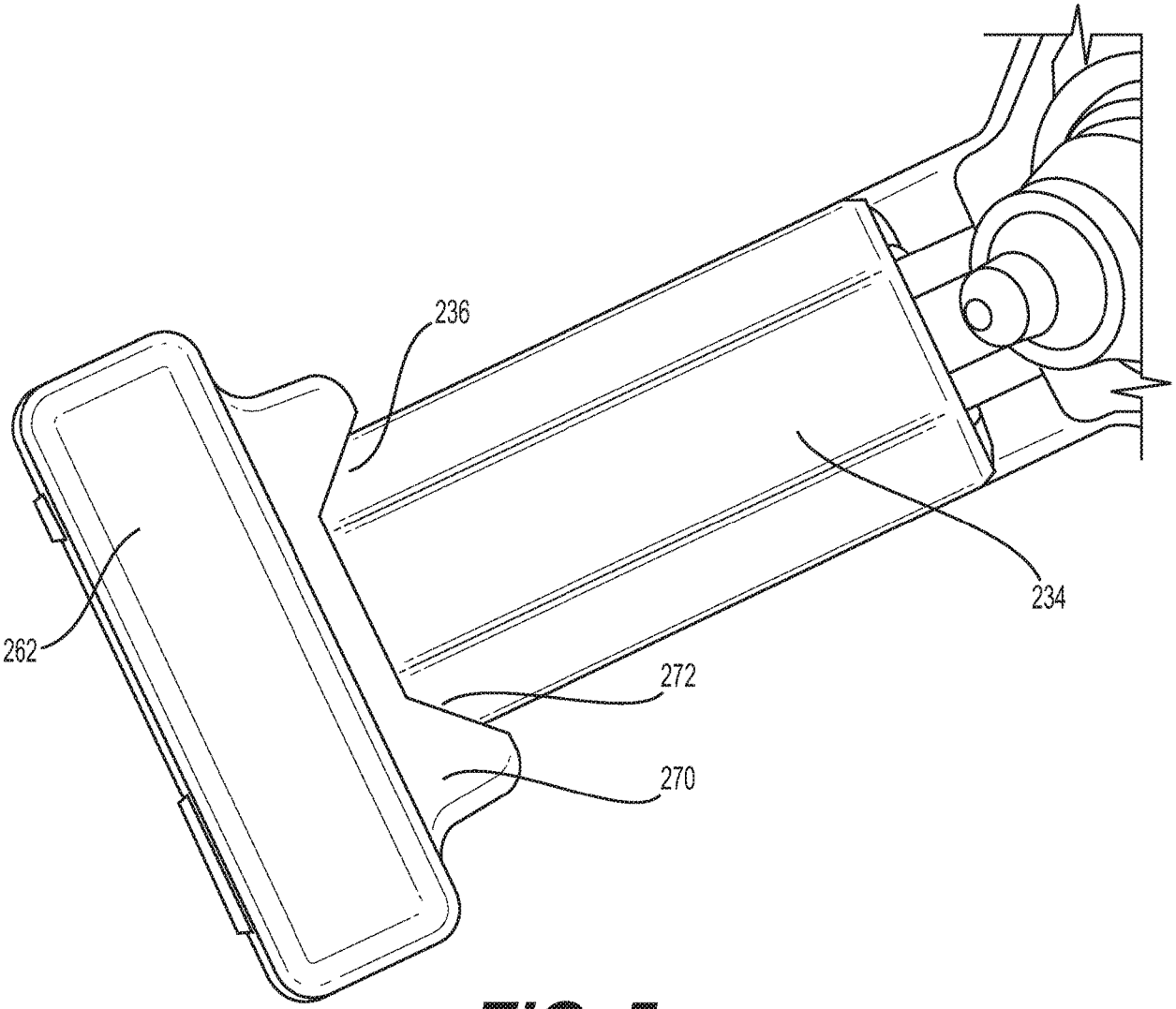
FIG. 5 is a top plan view of the cutting tool with the rectangular-shaped paddle of FIG. 2.

At least one fastener 52 (best seen in FIG. 4) may pass through paddle 262, 362 and a radially extending portion of flighting 234 in a direction that is essentially aligned with the direction of rotation of rotary head 24 and substantially tangential to the cylindrical outer peripheral surface of rotary head 24. Each paddle 262, 362 may include a block of material configured for attachment to leading edge 254 of flighting 234, and two ear portions 270, 370 protruding from opposite sides of a flat, centrally-located, aft-facing surface 271, 371 of the block of material (best seen in FIGS. 6 and 7). In the various exemplary disclosed embodiments paddles 262, 362 extend from the rectangular-shaped or V-shaped blocks of material for each paddle in an aft-facing direction opposite to a direction of rotation of rotary head 24. Each of ear portions 270, 370 may include an inwardly-facing chamfered surface 272, 372 configured to contact an outwardly-facing, leading edge chamfered surface 236 of flighting 234 (best seen in FIGS. 5 and 9) such that a gap 420 (FIG. 9) is maintained between a flat leading edge surface 254 of flighting 234 located in between outwardly-facing, leading edge chamfered surfaces 236 and flat, centrally-located, aft-facing surface 271, 371 of the block of material of paddle 262, 362 when the block of material is tightly attached to flighting 234. As will be apparent from the figures, the inwardly-facing chamfered surfaces of each of the two ear portions on each paddle face each other in a direction substantially parallel to a central axis of rotary head 24, and the outwardly-facing, leading edge chamfered surfaces at the leading edge of flightings 234 mate with the inwardly-facing chamfered surfaces of the ear portions when the paddles are joined to the flightings.

As shown in the exemplary embodiment of FIG. 2, each of a cutting tool 228 may include an individual flighting 234, mounting block 244, and cutting bit 248. Flightings 234 may be welded or otherwise joined to a cylindrical outer surface of rotary head 24, with one mounting block 244 fixedly connected to each flighting 234. A cutting bit 248 may be removably disposed within each mounting block 244, with a base 247 of cutting bit 248 engaged with mounting block 244.

Each flighting 234 may be plate-like and include a curved base end that is joined to the cylindrical outer surface of rotary head 24 and a generally flat distal end located opposite the base end at a radially outer surface of the flighting 234 once the flighting is joined to rotary head 24. In one embodiment, flightings 234 may be separately cut from steel plate stock, although other materials and fabrication methods (e.g., cast or forged iron or steel) may also be used in the manufacturing of flightings 234. Each flighting 234 may include flat leading edge surface 254 that extends from the base end at the cylindrical outer surface of rotary head 24 to the distal end, and a trailing edge located opposite leading edge surface 254. Leading and trailing edges of each flighting 234 may be generally aligned with the rotational direction of rotary head 24 of reclaiming drum 16. Reference to a "leading" edge or surface herein means the edge or surface facing in the direction of rotation of rotary head 24 during a reclaiming operation. Likewise, an "aft-facing" edge or surface means an edge or surface facing opposite to the direction of rotation of rotary head 24 during a reclaiming operation.

One or more mounting features may be located within flighting 234 at leading edge surface 254. In one example (shown in FIG. 4), the mounting features may include fasteners 52 passing through holes 264 formed through a rectangular-shaped block 262 (shown in FIG. 7) and through an upper radially extending portion of flighting 234. The holes 264 may be formed along a centerline of rectangular-shaped block 262, extending between a flat, centrally-located, aft-facing surface 271 of rectangular-shaped block 262 to a leading edge surface of rectangular-shaped block 262. Holes 264 may be countersunk into the leading edge surface of rectangular-shaped block 262 such that a head of each fastener 52 may be sunk below the leading edge surface of rectangular-shaped block 262 when the block is fastened to flighting 234. Fasteners 52 and holes through which fasteners 52 pass in the radially extending portions of flighting 234 may extend in a direction that is substantially aligned with the direction of rotation of rotary head 24 and substantially tangential to the cylindrical outer surface of rotary head 24.

Figure 9:
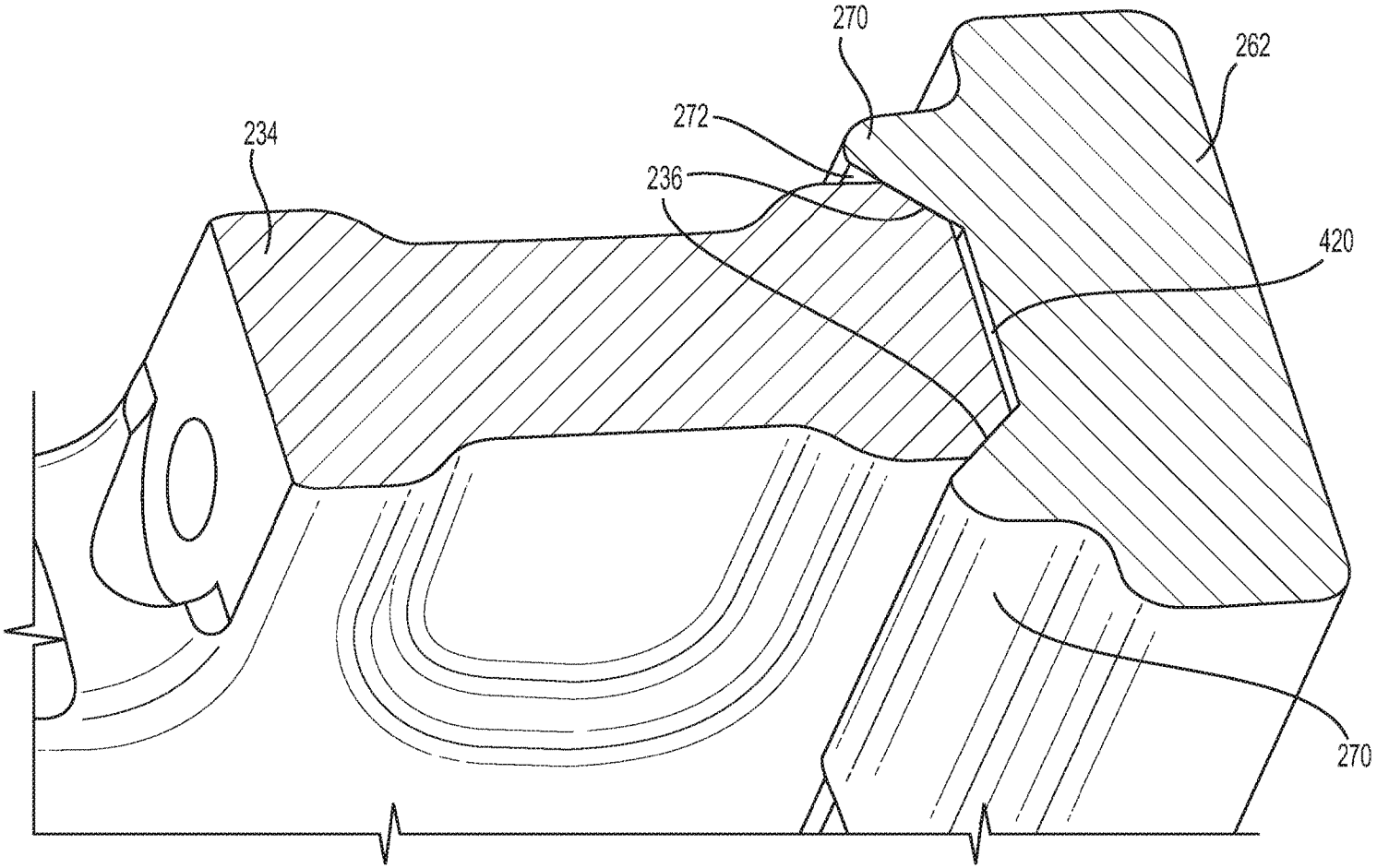
FIG. 9 is a perspective view in partial cross-section showing the interconnection between the rectangular-shaped paddle and the flighting of the exemplary cutting tool of FIG. 2.

As best seen in FIG. 9, paddle 262 only contacts flighting 234 when tightly attached to flighting 234 along inwardly-facing chamfered surfaces 272 of the two ear portions 270. As a result, all of a preload exerted by paddle 262 on flighting 234 when paddle 262 is tightly attached to flighting 234 is exerted along the angled interfacing chamfered surfaces of the paddle and the flighting. The angles of the chamfered interfacing contact surfaces ensure that the preload between the contacting surfaces of the flighting and the paddle created by tightening fasteners 52 includes at least a force component orthogonal to fasteners 52. Similarly, V-shaped paddles 362 only contact flighting 234 when tightly attached to flighting 234 along inwardly-facing chamfered surfaces 372 (see FIG. 6) of ear portions 370. As a result, all of a preload exerted by V-shaped paddle 362 on flighting 234 when V-shaped paddle 362 is tightly attached to flighting 234 is exerted along the angled interfacing chamfered surfaces of the paddle and the flighting. This design configuration at the joints between paddles 262, 362 and flightings 234 ensures that loads exerted on the paddles during a reclaiming operation as material impacts outwardly facing surfaces of the paddles are transferred through the angled interfacing chamfered surfaces into the flightings rather than creating shear forces at a flat bolted interface between the paddles and the flightings. The loads on paddles 262, 362 during a reclaiming operation are largely absorbed by the flightings as a result of the angled interfacing chamfered surfaces between the paddles and the flightings, rather than resulting in the creation of large shearing forces on a flat bolted interface between the paddles and the flightings.

Figure 6:
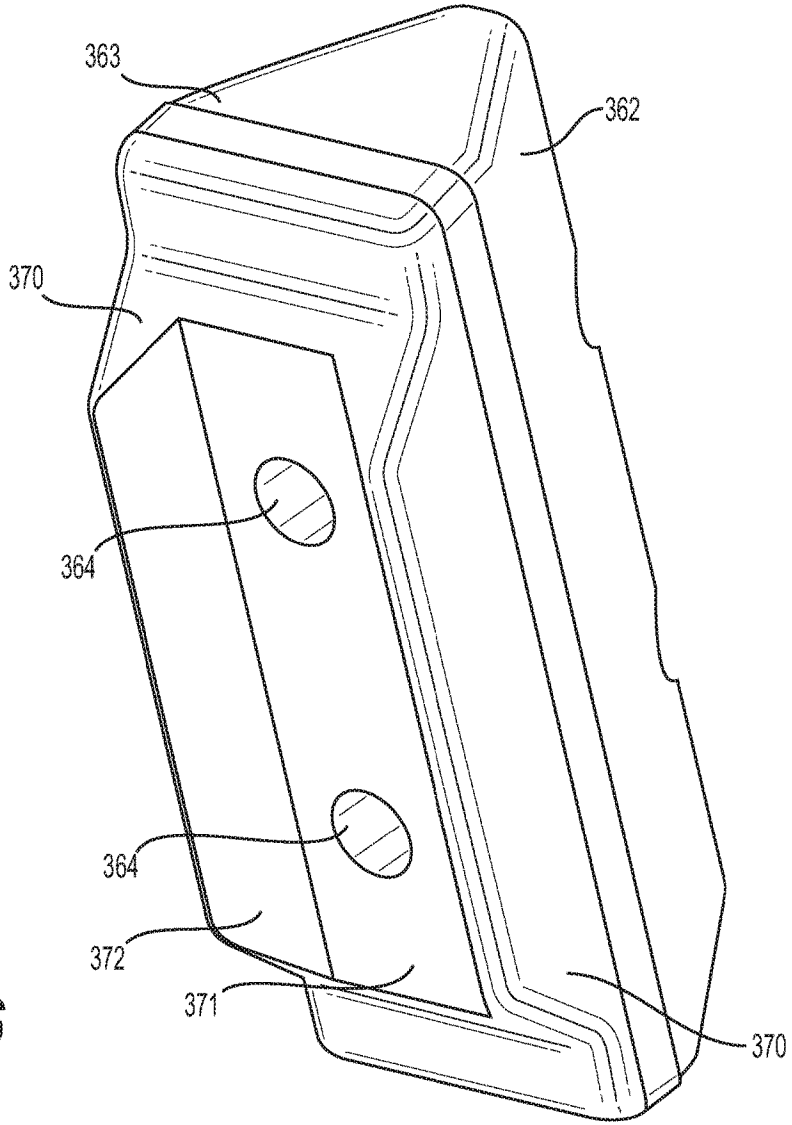
FIG. 6 is an illustration of the V-shaped paddle of FIG. 3.
Figure 7:
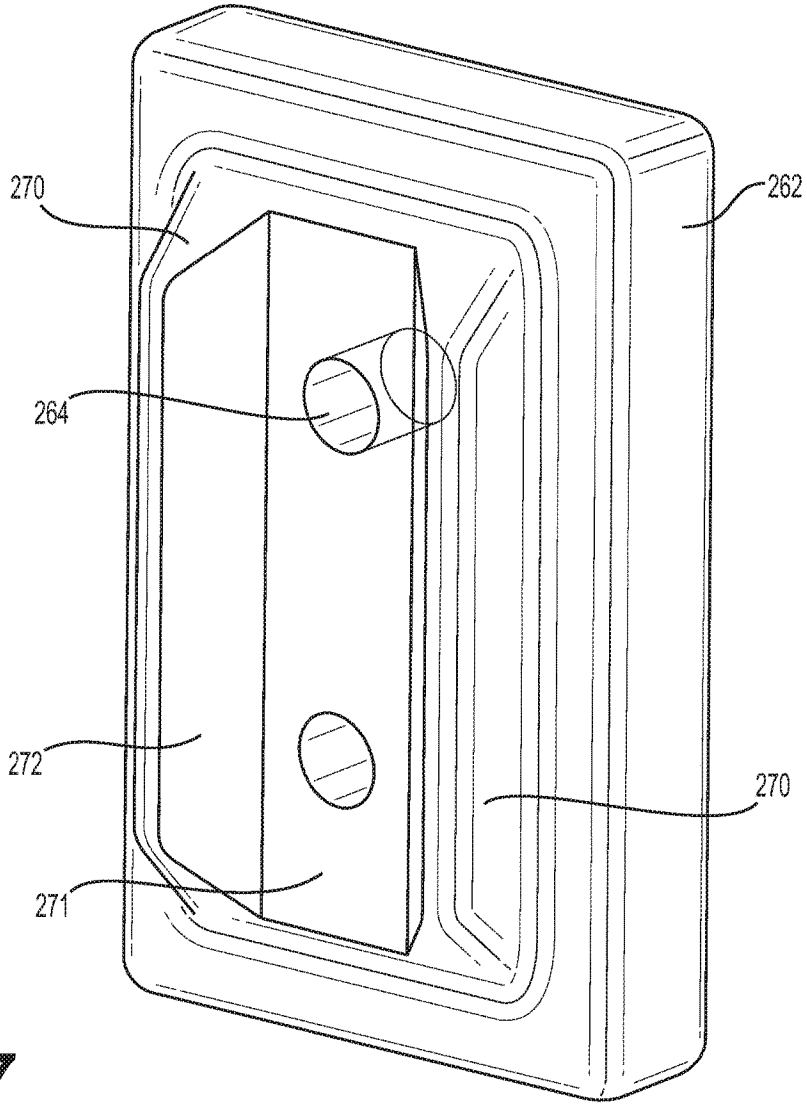
FIG. 7 is an illustration of the rectangular-shaped paddle of FIG. 2.
Figure 8:
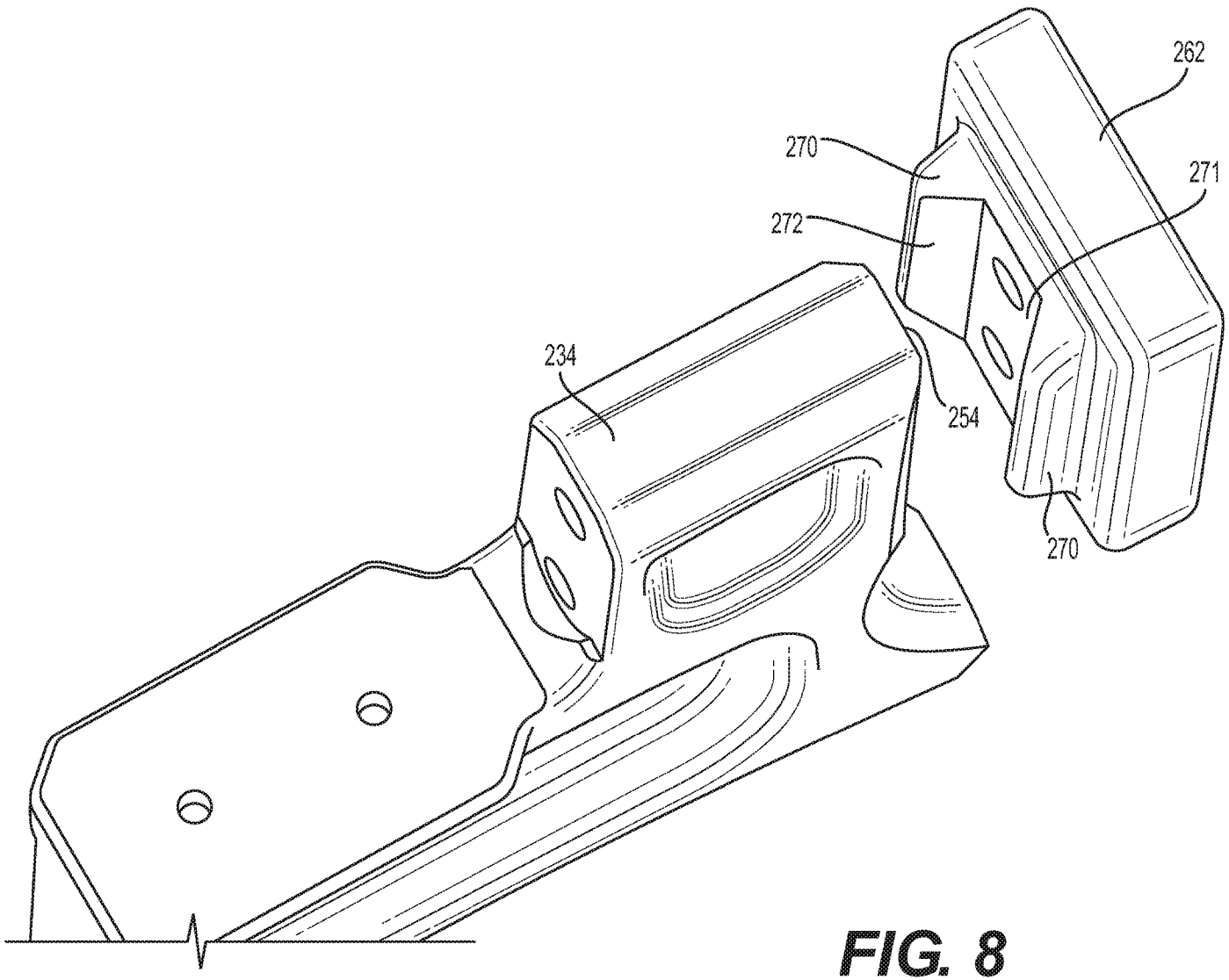
FIG. 8 is an exploded view showing a rectangular-shaped paddle in position to be connected to a flighting.

As best seen in the exemplary embodiment of FIGS. 6 and 7, each of the ear portions 270, 370 of paddles 262, 362 extend parallel to each other along the majority of the length of the block of material, and are symmetrically arranged on both sides of a centerline of the block of material. Each of ear portions 270, 370 further includes an outwardly-facing surface that tapers inwardly from a proximal end of the ear portion at the block of material to intersect with the inwardly-facing chamfered surface 272, 372 at a distal end of the ear portion. These tapered, outwardly-facing surfaces of ear portions 270, 370 also serve to deflect impacts from material contacting paddles 262, 362 during a reclaiming operation, thus reducing loads exerted on flighting 234. Ear portions 270, 370 extend parallel to each other along the majority of the length of the block of material for paddles 262, 362, and are symmetrically arranged on both sides of a centerline of the block of material.

As best seen in FIG. 9, a distance between lines of intersection where proximal edges of each of the inwardly-facing chamfered surfaces 272, 372 of ear portions 270, 370 meet the flat, centrally-located, aft-facing surface 271, 371 of the block of material of paddle 262, 362 is less than a distance between lines of intersection where the outwardly-facing chamfered surfaces 236 of flighting 234 meet the flat leading edge surface 254 of flighting 234. This ensures that a gap 420 remains between flat, centrally-located, aft-facing surface 271, 371 of the block of material of paddle 262, 362 and flat leading edge surface 254 of flighting 234 even when each paddle 262, 362 is tightly attached to flighting 234 by fasteners 52. As a result, the preloads between the interfacing surfaces of paddles 262, 362 and flightings 234 generated by tightening fasteners 52 include force components normal to flighting 234. These preloads do not tend to be loosened due to repeated side impacts on paddles 262, 362, and failures of the joints caused by relative movement between paddles 262, 362 and flighting 234 if the joints are loosened can be avoided.

As also best seen in FIG. 7 of an embodiment of a rectangular-shaped paddle 262, the block of material making up paddle 262 is generally rectangular in shape and extends outwardly from a centerline of the block of material past each of the ear portions 270 along a length of the block of material. The inwardly-facing chamfered surfaces 272, 372 of ear portions 270, 370 may also form an angle relative to a central axial plane of paddles 262, 362 that falls within a range from approximately 30 degrees to approximately 60 degrees. In some embodiments, the angles of inwardly-facing chamfered surfaces 272, 372 of ear portions 270, 370 relative to the central axial plane of paddles 262, 362 may be approximately 45 degrees. The steeper the angle along the interfacing chamfered surfaces at the joint between the paddles and the flighting, the greater the normal force transferred into the flighting from impacts on the paddles during a reclaiming operation.

Each mounting block 244 may be fixedly connected to a distal end of a corresponding flighting 234, for example by welding, and configured to removably receive one cutting bit 48. Mounting block 244 may include a generally block-like base portion 258 that engages flighting 234, and a cylindrical tool holder portion integrally formed therewith for engaging with base 247 of cutting bit 248. An axis of each tool holder portion engaged with base 247 of cutting bit 248 may be generally aligned with the rotational direction of rotary head 24. Base 247 of each cutting bit 248 may be received within the tool holder portion via a press-fit interference.

Cutting bit 248 may have a generally cylindrical body, and include a pointed hardened tip that engages roadway surface 20 and base 22 during a reclaiming operation. In one example, the tip of cutting bit 248 may be fabricated from tungsten carbide, though other materials may also or alternatively be utilized. Although not shown, cutting bit 248 may also include a spring clip that surrounds the cylindrical body and functions to retain cutting bit 248 within a tool holder portion, as is known in the art. In some embodiments, a washer may initially be located around the spring clip to hold the spring clip in a pre-loaded state, the washer then moving during assembly to an end of the spring clip to protect the corresponding tool holder portion of mounting block 244 from relative movement of cutting bit 248.

As described above, during rotation of reclaiming drum 16, cutting tool 228 (including flighting 234, mounting block 244, and cutting bit 248) may be forced through roadway surface 20 and base 22. This material may be hard and abrasive, and impingement and rubbing of this material against cutting tool 228 may cause cutting tool 228 to wear. To help prolong the useful life of cutting tool 228, in addition to their functions of breaking up and mixing material removed by cutting bits 248, paddles 262, 362 may be connected to cutting tool 228 to act as sacrificial wear surfaces. In some applications, paddles 262, 362 may be mounted to leading edge 254 of flighting 234 to protect flighting 234, and also extend a distance away from outer surface 30 of rotary head 24 to protect mounting block 244. In the disclosed embodiments, paddles 262, 362 may extend radially outward to an edge of mounting block 244, although other configurations may alternatively be utilized if desired. Aft-facing ear portions 270, 370, extending in a direction opposite to the direction of rotation of reclaiming drum 16 along opposite sides of a leading edge of flighting 234 may also help deflect material from a direct impact on cutting tool 228.

Paddles 262, 362 may be removably mounted in a generally orthogonal orientation relative to flighting 234 (referring to FIG. 2), and the width thereof may be greater than the thickness of flighting 234. That is, paddle 262 may extend in the axial direction of reclaiming drum 16 a distance past both sides of flighting 234. The location of paddle 262 may help to protect leading edge 254 of flighting 234, while the width of paddle 262 may help to deflect material away from the large planer sides of flighting 234. In one exemplary embodiment, the extension distance of paddle 262 past the planer sides of flighting 234 may be about equal to a thickness of flighting 234, although other configurations may also be possible. Paddle 262 may be mounted to flighting 234 by way of one or more threaded fasteners 52. In particular, fasteners 52 may act as a mounting mechanism and pass through holes 264, 364 in paddles 262, 362 to engage the mounting features of flighting 234. In the disclosed embodiments, two holes 264, 364 are formed within paddles 262, 362 and oriented in a direction that is substantially tangential to an outer peripheral surface of rotary drum 24.

Paddle 262, 362 may be generally symmetric in the length direction. Specifically, a plane passing through a center of paddle 262, 362 between holes 264, 364 may define a vertical plane of symmetry for each paddle 262, 362. With this configuration, each paddle 262, 362 may be reversible. That is, after a period of use, an upper end of paddle 262, 362 (i.e., the end of paddle 262 extending past flighting 234 toward mounting block 244) may wear. Rather than replacing a worn paddle 262 with a new paddle 262, the worn paddle may instead simply be inverted (turned by about) 180° and used for an extended period of time.

INDUSTRIAL APPLICABILITY

The disclosed paddles and reclaiming drum may be used within any road reclaimer for the breaking up, fragmenting, pulverizing, and mixing of roadway surface material. The disclosed paddles and reclaiming drum may improve longevity of machine components, while also decreasing servicing difficulty, time, and expense. Component longevity may be increased through the unique design of the disclosed paddles that functions to protect the associated cutting tools from excessive wear. In particular, the configuration at the joints between the paddles and the flightings where all loads on the paddles are transferred into the flightings through angled, interfacing chamfered surfaces, ensures that normal loads are transferred into sides of the flighting rather than acting to loosen the bolted joint between the paddles and the flightings.

The angled, interfacing chamfered surfaces of the ear portions of the paddles and the leading edge of the flightings are also configured such that a gap 420 is defined between the centrally-located, aft-facing surface 271, 371 of the block of material of each paddle 262, 362 and flat leading edge surface 254 of flighting 234 even when each paddle 262, 362 is tightly attached to flighting 234 by fasteners 52. As a result, the preloads between the interfacing surfaces of paddles 262, 362 and flightings 234 generated by tightening fasteners 52 include force components normal to flighting 234. These preloads do not tend to be loosened due to repeated side impacts on paddles 262, 362, and failures of the joints caused by relative movement between paddles 262, 362 and fighting 234 if the joints are loosened can be avoided. The work life of paddles 262, 362 and flightings 234 is increased, and potential down time for tightening of fasteners 52 to avoid movement between the paddles and the flightings after a period of use on reclaiming drum 16 is reduced. Additional benefits of various embodiments according to this disclosure may include the reduction in the amount of power required to rotate reclaiming drum 16 when V-shaped paddles 362 are mounted on flightings 234. As discussed above, while the V-shaped paddles may require less power to rotate since they present a smaller frontal area to the material that has been removed by cutting bits 248, the V-shaped paddles may also result in the material being left with a coarser gradation than when rectangular-shaped paddles are employed. The ability to readily interchange V-shaped paddles with rectangular-shaped paddles provides more versatility for the reclaiming drum 16. In various applications, a tradeoff may be made between power requirements for rotating reclaiming drum 16 and the need for a finer gradation of the material being broken up and mixed by the paddles.

It will be apparent to those skilled in the art that various modifications and variations can be made to the disclosed paddles and reclaiming drum without departing from the scope of the disclosure. Other embodiments of the paddles and reclaiming drum will be apparent to those skilled in the art from consideration of the specification and practice of the paddles and reclaiming drum disclosed herein. It is intended that the specification and examples be considered as exemplary only, with a true scope of the disclosure being indicated by the following claims and their equivalents.

What is claimed is:

1. A paddle for a reclaiming drum comprising:

a block of material configured for attachment to a leading edge of a fighting supporting a cutting bit on the reclaiming drum, the block of material assisting in breaking up and mixing of material removed from a surface by the cutting bit as the reclaiming drum is rotated and moved into the surf ace; and two ear portions protruding from opposite sides of a flat, centrally-located, aft-facing surface of the block of material, each of the ear portions being free of any openings to receive a fastener for connecting the paddle to the fighting and including an inwardly-facing chamfered surface configured to interface with an outwardly-facing, leading edge chamfered surface of the fighting such that a gap is maintained between a flat leading edge surface of the fighting located in between the outwardly-facing chamfered surfaces and the flat, centrally-located, aft-facing surface of the block of material when the block of material is attached to the fighting, wherein the two ear portions are symmetrically arranged on both sides of a centerline of the block of material.

2. The paddle of claim 1, wherein the paddle only contacts the fighting when attached to the fighting along the inwardly-facing chamfered surfaces of the two ear portions such that a preload exerted by the paddle on the fighting when the paddle is attached to the fighting includes at least a force component orthogonal to one or more fasteners attaching the paddle to the flighting.

3. The paddle of claim 1, wherein the block of material includes a plurality of axial openings extending through the block of material and located along a centerline of the block of material, each of the axial openings configured to receive a fastener for connecting the paddle to the fighting.

4. The paddle of claim 1, wherein each of the ear portions further includes an outwardly-facing surface that tapers inwardly from a proximal end of the ear portion at the block of material to intersect with the inwardly-facing chamfered surface at a distal end of the ear portion.

5. The paddle of claim 1, wherein the ear portions extend parallel to each other along the majority of the length of the block of material.

6. The paddle of claim 1, wherein a distance between lines of intersection where proximal edges of each of the inwardly-facing chamfered surfaces of the ear portions meet the flat, centrally-located, aft-facing surface of the block of material is less than a distance between lines of intersection where the outwardly-facing chamfered surfaces of the fighting meet the flat leading edge surface of the fighting.

7. The paddle of claim 1, wherein the block of material is generally rectangular and extends outwardly from a centerline of the block of material past each of the ear portions along a length of the block of material.

8. The paddle of claim 1, wherein the inwardly-facing chamfered surfaces of the ear portions form an angle relative to a central axial plane of the paddle that falls within a range from approximately 30 degrees to approximately 60 degrees.

9. The paddle of claim 1, wherein the block of material is generally V-shaped in configuration.

10. A cutting tool for a reclaiming drum, comprising:

a plate-like fighting configured to be connected to the reclaiming drum at a first end in general alignment with a rotational direction of the reclaiming drum and supporting a cutting bit at a second end of the fighting; and a paddle, wherein the paddle includes:

a block of material configured for attachment to a leading edge of the fighting, the block of material assisting in breaking up and mixing of material removed from a surface by the cutting bit as the reclaiming drum is rotated and moved into the surface; and two ear portions protruding from opposite sides of a flat, centrally-located, aft-facing surface of the block of material, each of the ear portions including an inwardly-facing chamfered surface configured to interface with an outwardly-facing, leading edge chamfered surface of the fighting such that a gap is maintained between a flat leading edge surface of the fighting located in between the outwardly-facing chamfered surfaces and the flat, centrally-located, aft-facing surface of the block of material when the block of material is attached to the flighting.

11. The cutting tool of claim 10, wherein the paddle only contacts the flighting when attached to the fighting along the inwardly-facing chamfered surfaces of the two ear portions such that a preload exerted by the paddle on the fighting when the paddle is attached to the flighting includes at least a force component orthogonal to one or more fasteners attaching the paddle to the flighting.

12. The cutting tool of claim 10, wherein the block of material includes a plurality of axial openings extending through the block of material and located along a centerline of the block of material, each of the axial openings configured to receive a fastener for connecting the paddle to the fighting.

13. The cutting tool of claim 10, wherein each of the ear portions further includes an outwardly-facing surface that tapers inwardly from a proximal end of the ear portion at the block of material to intersect with the inwardly-facing chamfered surface at a distal end of the ear portion.

14. The cutting tool of claim 10, wherein the ear portions extend parallel to each other along the majority of the length of the block of material, and are symmetrically arranged on both sides of a centerline of the block of material.

15. The cutting tool of claim 10, wherein a distance between lines of intersection where proximal edges of each of the inwardly-facing chamfered surfaces of the ear portions meet the flat aft-facing surface of the block of material is less than a distance between lines of intersection where the outwardly-facing chamfered surfaces of the fighting meet the flat leading edge surface of the fighting.

16. The cutting tool of claim 10, wherein the block of material is generally rectangular and extends outwardly from a centerline of the block of material past each of the ear portions along a length of the block of material.

17. The cutting tool of claim 10, wherein the inwardly-facing chamfered surfaces of the ear portions form an angle relative to a central axial plane of the paddle that falls within a range from approximately 30 degrees to approximately 60 degrees.

18. The cutting tool of claim 10, wherein the block of material is generally V-shaped in configuration.

19. A reclaiming drum, comprising:

a head having a cylindrical outer peripheral surface;

a plurality of flightings separately joined at a first end to the reclaiming drum at spaced apart locations around the outer peripheral surface of the head;

a tool mounting block fixedly connected to a second end of each of the plurality of flightings;

a cutting bit disposed within each tool mounting block;

a paddle removably connected at a leading edge of each of the plurality of flightings;

and at least one fastener passing through the paddle and a radially extending portion of one of the plurality of flightings, wherein each paddle includes:

a block of material configured for attachment to the leading edge of the fighting, and two ear portions protruding from opposite sides of a flat, centrally-located, aft-facing surface of the block of material, each of the ear portions including an inwardly-facing chamfered surface configured to contact an outwardly-facing, leading edge chamfered surface of the fighting such that a gap is maintained between a flat leading edge surface of the fighting located in between the outwardly-facing chamfered surfaces and the flat, centrally-located, aft-facing surface of the block of material when the block of material is attached to the fighting.

20. The reclaiming drum of claim 19, wherein the block of material is configured as one of a rectangular-shaped block or a V-shaped block.

* * * * *